US011105216B2

(12) United States Patent
Giovannetti et al.

(10) Patent No.: US 11,105,216 B2
(45) Date of Patent: Aug. 31, 2021

(54) METHOD OF MANUFACTURING A COMPONENT OF A TURBOMACHINE, COMPONENT OF A TURBOMACHINE AND TURBOMACHINE

(71) Applicant: Nuovo Pignone Srl, Florence (IT)

(72) Inventors: Iacopo Giovannetti, Florence (IT); Massimo Giannozzi, Florence (IT); Giovanni Salvestrini, Florence (IT); Girolamo Tripoli, Florence (IT); Marco Boncinelli, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 523 days.

(21) Appl. No.: 15/310,937

(22) PCT Filed: May 13, 2015

(86) PCT No.: PCT/EP2015/060610

§ 371 (c)(1),
(2) Date: Nov. 14, 2016

(87) PCT Pub. No.: WO2015/173312

PCT Pub. Date: Nov. 19, 2015

(65) Prior Publication Data

US 2017/0089214 A1 Mar. 30, 2017

(30) Foreign Application Priority Data

May 15, 2014 (IT) ..... CO2014A000016

(51) Int. Cl.
*F01D 11/12* (2006.01)
*F01D 5/28* (2006.01)

(52) U.S. Cl.
CPC ..... *F01D 11/122* (2013.01); *F01D 5/286* (2013.01); *F01D 5/288* (2013.01);
(Continued)

(58) Field of Classification Search
CPC ..... F01D 11/12; F01D 11/122; F01D 21/045; F01D 5/284; F01D 5/286; F01D 5/288;
(Continued)

(56) References Cited

U.S. PATENT DOCUMENTS 3,918,139 A * 11/1975 Felten ..... C22C 19/00 420/444
4,239,452 A * 12/1980 Roberts, Jr. ..... F01D 11/12 415/173.5

(Continued)

FOREIGN PATENT DOCUMENTS

CN 1457384 A 11/2003
CN 102084090 A 6/2011

(Continued)

OTHER PUBLICATIONS

Machining—Wikipedia, the free encyclopedia (Year: 2011).*

(Continued)

*Primary Examiner* — Woody A Lee, Jr.
*Assistant Examiner* — Maxime M Adjagbe
(74) *Attorney, Agent, or Firm* — Baker Hughes Patent Org.

(57) ABSTRACT

The component of the turbomachine comprises a body of the component, a bond layer covering a base surface of the body, and a top layer covering the bond layer and made of abradable ceramic material. The base surface of the component has patterned protrusions and, through two covering steps used for forming the bond layer and the top layer, also the top surface of the component has patterned protrusions. The pattern protrusions of the base surface may be obtained in different ways, for example casting, milling, grinding, electric discharge machining or additive manufacturing. The patterned protrusions belong to an abradable seal of the turbomachine, and may be shaped and sized to maintain
(Continued)

specified clearances and to reduce flow of a working fluid within turbomachinery equipment and/or it's components.

18 Claims, 4 Drawing Sheets

(52) U.S. Cl.
CPC ..... *F05D 2250/11* (2013.01); *F05D 2250/13* (2013.01); *F05D 2250/18* (2013.01); *F05D 2250/181* (2013.01)

(58) Field of Classification Search
CPC ..... F05D 2230/10; F05D 2300/20; F05D 2300/175; F05D 2300/603; F05D 2300/6033; F05D 2250/18–185; F05D 2230/30–314; F04D 29/526; Y10T 29/4932; Y10T 29/49336; Y10T 29/49337; Y10T 29/49339; Y10T 29/49982; B23P 15/006
See application file for complete search history.

(56) References Cited

U.S. PATENT DOCUMENTS

| | | | | |
|---|---|---|---|---|
| 4,269,903 | A * | 5/1981 | Clingman | C23C 4/18 415/173.4 |
| 4,594,053 | A | 6/1986 | Sohngen | |
| 4,764,089 | A * | 8/1988 | Strangman | F01D 11/122 415/173.4 |
| 5,064,727 | A * | 11/1991 | Naik | C23C 30/00 415/173.4 |
| 5,561,827 | A * | 10/1996 | Reeves | B22F 1/0003 419/10 |
| 5,756,217 | A * | 5/1998 | Schroder | F01D 5/20 428/148 |
| 6,007,880 | A * | 12/1999 | Maloney | C23C 14/083 427/250 |
| 6,372,299 | B1 | 4/2002 | Thompson | |
| 6,457,939 | B2 * | 10/2002 | Ghasripoor | F01D 11/122 29/889.2 |
| 6,461,108 | B1 * | 10/2002 | Lee | C23C 28/00 416/96 R |
| 6,703,137 | B2 * | 3/2004 | Subramanian | C23C 4/18 416/241 B |
| 6,730,413 | B2 * | 5/2004 | Schaeffer | C23C 28/321 416/241 B |
| 7,600,968 | B2 * | 10/2009 | Nelson | F01D 11/122 415/173.4 |
| 7,614,847 | B2 * | 11/2009 | Nelson | F01D 11/122 415/173.4 |
| 8,939,707 | B1 * | 1/2015 | Lee | F01D 11/122 415/1 |
| 9,598,973 | B2 | 3/2017 | Ghasripoor et al. | |
| 9,713,912 | B2 | 7/2017 | Lee | |
| 2001/0004436 | A1 | 6/2001 | Chasripoor et al. | |
| 2005/0003172 | A1 * | 1/2005 | Wheeler | C23C 4/04 428/210 |
| 2008/0044273 | A1 * | 2/2008 | Khalid | F04D 29/164 415/57.4 |
| 2009/0017260 | A1 | 1/2009 | Kulkarni et al. | |
| 2013/0004305 | A1 * | 1/2013 | Giovannetti | F01D 11/122 415/196 |
| 2014/0023482 | A1 | 1/2014 | Kunihiko | |
| 2015/0337672 | A1 * | 11/2015 | McCaffrey | F01D 11/08 415/173.1 |

FOREIGN PATENT DOCUMENTS

| | | | |
|---|---|---|---|
| CN | 102434220 | A | 5/2012 |
| EP | 0 256 790 | A2 | 2/1988 |
| EP | 0256790 | A2 | 2/1988 |
| EP | 2 141 328 | A1 | 1/2010 |
| EP | 2 275 645 | A2 | 1/2011 |
| EP | 2444515 | A2 | 4/2012 |
| JP | 2013170578 | A | 9/2013 |
| JP | 2013209981 | A | 10/2013 |
| JP | 2014020329 | A | 2/2014 |
| RU | 2 039 631 | C1 | 7/1995 |
| WO | 2011053448 | A1 | 5/2011 |
| WO | 2011/085376 | A1 | 7/2011 |
| WO | 2011085376 | A1 | 7/2011 |

OTHER PUBLICATIONS

Nickel aluminide—wikipedia, the free encyclopedia (Year: 2013).*
Italian Search Report and Opinion issued in connection with corresponding IT Application No. CO2014A000016 dated Jan. 8, 2015.
PCT Search Report and Written Opinion issued in connection with corresponding PCT Application No. PCT/EP2015/060610 dated Aug. 31, 2015.
First Office Action and Search issued in connection with corresponding CN Application No. 201580025226.X dated Oct. 9, 2017.
Office Action and Search issued in connection with corresponding RU Application No. 2016143520 dated Oct. 17, 2018 (English Translation Not Available).

* cited by examiner

METHOD OF MANUFACTURING A COMPONENT OF A TURBOMACHINE, COMPONENT OF A TURBOMACHINE AND TURBOMACHINE

BACKGROUND

Embodiments of the subject matter disclosed herein relate to methods of manufacturing a component of a turbomachine, components of a turbomachine and turbomachines.

More particularly, the applications of the present embodiments are in the field of seal systems for turbomachines.

There are many types of known seal systems for turbomachines; one of these types is commonly called an "abradable seal" and comprises an abradable part and an abrading part; in general, the abradable part is provided on a stationary component of the turbomachine (for example the inner surface of a casing of a turbine, i.e. the shroud surface) and the abrading part is provided on a rotatable component of the turbomachine (for example the airfoil tips of the blades of a bucket assembly of a turbine). During start-up of the turbomachine, when the turbomachine rotor starts rotating and consequently the rotatable component rotates, the abrading part abrades (slightly) the abradable part; subsequently, the abrading part and the abradable part define a clearance therebetween. The abradable part has patterned protrusions made of ceramic material; the material used for the abradable part is very hard, typically more than 90 HR15Y, but less hard than the material used for the abrading part.

In order to realize such ceramic patterned protrusions, first a flat surface and smoothed body of the component where they are desired is covered with a ceramic layer and then the ceramic layer is machined so to form protrusions.

Machining a ceramic layer is lengthy and expensive; furthermore, the machining tool dimension limits the size of the machining of the layer (for example, the distance between adjacent protrusions is not less that some millimeters).

BRIEF DESCRIPTION

Therefore, there is a need for an improved way of realizing patterned protrusions, in particular on a component of a turbomachine, in particular to be used in abradable seals.

Due to the complications of the process used till now for realizing such patterned protrusions, the shape (both the transversal shape and the longitudinal shape) and size (both the transversal size and the longitudinal size) of such patterned protrusions were, in practice, restricted, i.e. could not be chosen according to their best performances.

In an embodiment, the protrusions may be formed directly in the body of the component and then coated through one or more layers of ceramic material or materials. The body of the component may be made of metal material and therefore can be machined relatively easily; the overlying ceramic layer or layers does not need to be machined.

Furthermore, thanks to the above improved manufacturing of the protrusions, the present inventors have thought of shaping and sizing them to maintain specified clearances and to reduce flow of a working fluid within turbomachinery equipment and/or its components. In this way, the shape and size of the protrusions can be configured to increase the efficiency of a combustion gas turbine engine, while also reducing the rubbing of the turbine blades with the turbine casing, thereby increasing a useful life expectancy of the turbine blades.

A first aspect of the present invention is a method of manufacturing a component of a turbomachine. The method comprises the steps of providing a body of the component having a base surface; covering the base surface with a bond layer; and covering the bond layer with a top layer made of abradable ceramic material creating a top surface of the component. The base surface has patterned protrusions and, through the two covering steps, also the top surface of the component has patterned protrusions.

In this way, the shapes of the patterned protrusions of the top surface are similar to the shapes of patterned protrusions of the base surface.

A second aspect of the present invention is a component of a turbomachine. The component comprises a body of the component; a bond layer covering a base surface of the body; and a top layer covering the bond layer and being made of abradable ceramic material. Both the base surface and the top surface of the component have patterned protrusions.

A third aspect of the present invention is a turbomachine.

The turbomachine comprises at least one component as set out above.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the present invention that, in particular, is not limited to combustion gas turbine engines but may be applied to other kinds of turbomachines. Instead, the scope of the present invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
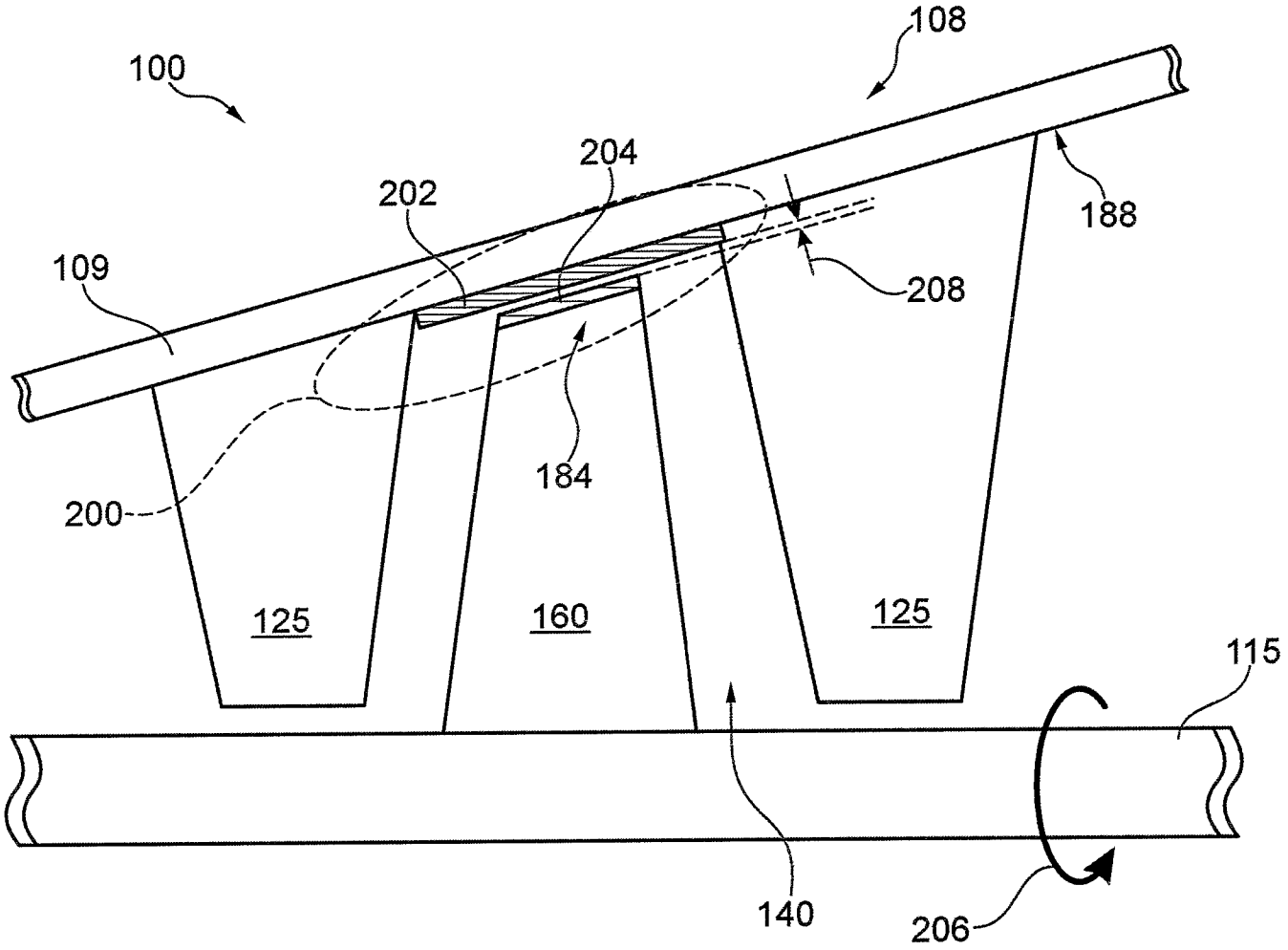
FIG. 1 shows schematically a turbine stage of a turbine section of a combustion gas turbine engine according to an exemplary embodiment of the present invention.

FIG. 1 refers to a combustion gas turbine engine 100; the basic sections of a gas turbine engine are the compressor section, the combustor section and the turbine section; FIG. 1 shows schematically a turbine stage 140 of the turbine section 108. The turbine section 108 is enclosed within a turbine casing 109. The turbine section comprises a rotor assembly and a stator assembly; the rotor assembly comprises a turbine shaft 115 and one or more bucket assemblies coupled to the turbine shaft 115, each bucket assembly comprising a plurality of turbine blades (or buckets) 160; the stator assembly comprises the turbine casing 109 and one or more nozzle assemblies coupled to the turbine casing 109, each nozzle assembly comprising a plurality of turbine vanes (or nozzles) 125. Each combination of a turbine bucket assembly and an adjacent nozzle assembly defines a turbine stage 140.

In FIG. 1, there is shown a schematic view of an exemplary seal system 200 that may be used with the combustion gas turbine engine 100, in particular with its turbine section 108. Each turbine blade 160 comprises an airfoil tip 184, the blades 160 projecting outwardly from the turbine shaft 115. The turbine casing 109 comprises an inner surface 188, the vanes 125 projecting inwardly from the turbine casing 109. In this exemplary embodiment, seal system 200 comprises an abradable part 202 located over the inner surface 188, i.e. the "shroud surface", and an abrading part 204 located over the airfoil tip 184. The abradable part 202 has a first hardness value and the abrading part 204 has a second hardness value that is greater than the first hardness value. In operation of the combustion gas turbine engine 100 (at start-up), a rotational motion 206 is induced in the turbine shaft 115 such that the abrading part 204 rubs against the abradable part 202 and a clearance gap 208 is defined between the abrading part 204 located at the airfoil tip 184 and the abradable part 202 formed at the turbine casing 109; the clearance gap 208 has a predetermined range of values that facilitates reducing a flow of working fluid (not shown in FIG. 1) between the turbine blades 160 and the turbine casing 109, thereby increasing the efficiency of the combustion gas turbine engine, while also reducing the rubbing of the turbine blades with the turbine casing, thereby increasing a useful life expectancy of the turbine blades.

Figure 2:
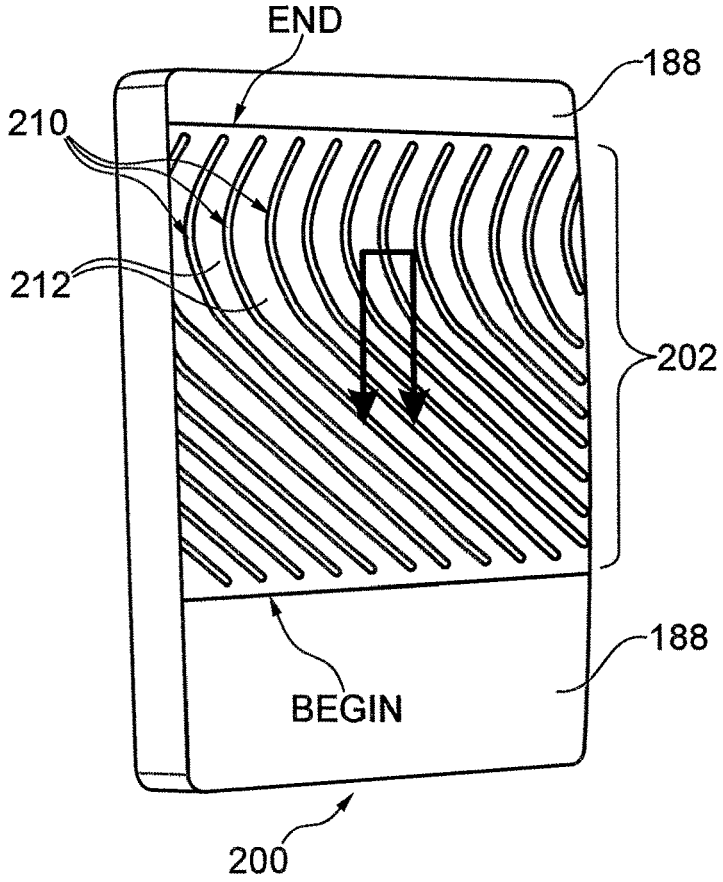
FIG. 2 shows schematically an exemplary portion of the inner surface of the turbine casing of the turbine section of FIG. 1.

FIG. 2 shows schematically an exemplary portion of the inner surface 188 in FIG. 1, i.e. the "shroud surface", partially covered with an abradable part 202. The abradable part 202 has a top surface with patterned protrusions in the form of a plurality of parallel (or substantially parallel) shaped "ridges" 210; each couple of adjacent "ridges" 210 is separated by a "lowland" 212. In this embodiment, each shaped ridge comprises: a first initial straight section (beginning at the BEGIN side of the seal), a second intermediate curved section contiguous with the first straight section, a third final straight section (longer that the first section) (ending at the END side of the seal) contiguous with the second curved section.

Figure 3:
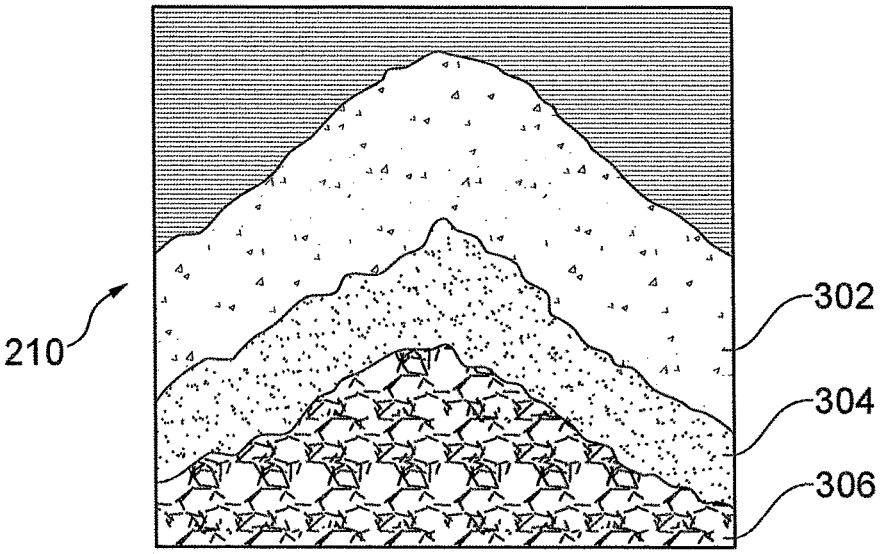
FIG. 3 shows a partial cross-section (transversal view) of a ridge of the exemplary embodiment of FIG. 2.

FIG. 3 shows a partial cross-section of a ridge 210 of the exemplary embodiment of FIG. 2; FIG. 3 shows a "peak" of a "mound"; this "peak" is pointed but, alternatively, it may correspond for example to a "plateau". In FIG. 3, there may be seen: a portion 306 of the body of the turbine casing 109, a bond layer 304 covering a base surface of the body (i.e. a portion of the inner surface 188 of the turbine casing 109), and a top layer 302 covering the bond layer 304 and made of abradable ceramic material.

The structure of FIG. 3 is obtained through the step of: providing the body 306 having a base surface that is not flat; then covering this base surface with the bond layer (304); and then covering the bond layer 304 with the top layer 302 of abradable ceramic material thus creating the top surface of the component (see FIG. 2).

As partially shown in FIG. 2, the base surface to be covered is a portion of the inner surface 188 and is preliminarily prepared before being coated, i.e. patterned protrusions are provided in the body 306 (see FIG. 2 and FIG. 3); after the two covering steps, also the top surface of the component has patterned protrusions (in this exemplary embodiment the protrusions correspond to the "ridges" 210).

Figure 4:
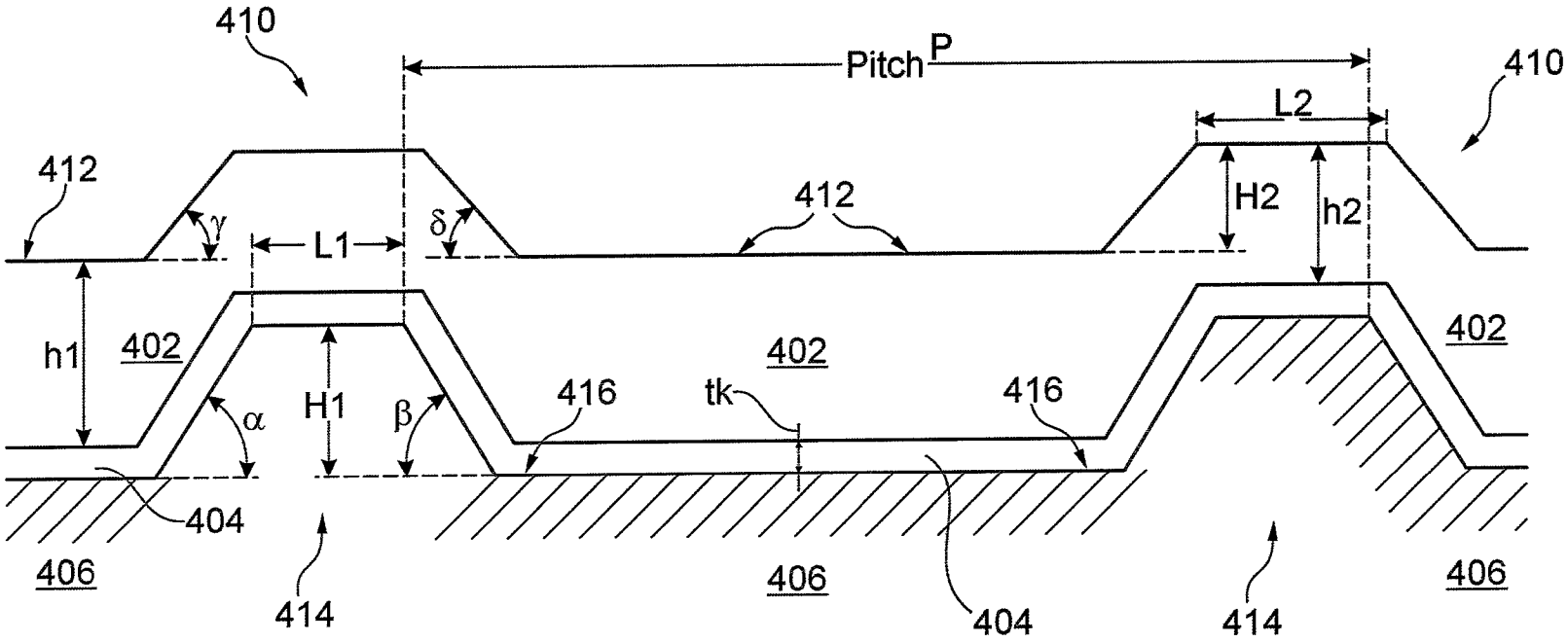
FIG. 4 shows schematically a partial cross-section (transversal view) of "ridges" and "lowlands" of a patterned abradable part, this view being used for explaining several exemplary embodiments of the present invention.

FIG. 4 also shows "ridges" and "lowlands" in cross-section. The protrusions of the base surface are labeled 414 and the protrusions of the top surface are labeled 410; more specifically, the "ridges" of the base surface are labeled 414 and the "lowlands" of the base surface are labeled 416 (these elements can not be seen after the end of manufacturing as they are concealed behind the bond layer and the top layer) while the "ridges" of the top surface are labeled 410 (similar to "ridges" 210 in FIG. 2) and the "lowlands" of the top surface are labeled 412 (similar to "lowlands" 212 in FIG. 2).

The patterned protrusions (414 in FIG. 4) of the base surface of the body (406 in FIG. 4) may be obtained for example by casting, milling, grinding, electric discharge machining or additive manufacturing.

The body (406 in FIG. 4) is made of a metal material and may be made for example of a stainless steel of the AISI 300 series, a nickel base superalloy, "inconel 738", "hastelloy x", "rene 108" or "rene 125". Metal materials can be easily and quickly shaped, for example machined.

The bond layer (404 in FIG. 4) may be made for example of MCrAlY (where M=Co, Ni or Co/Ni d); alternatively, it may be made of Ni3Al (nickel aluminide). This layer may be obtained by spraying, for example Physical Vapor Deposition (PVD), Low Pressure Plasma Spraying (LPPS), Vacuum Plasma Spraying (VPS), Air Plasma Spraying (APS), or High Velocity OxyFuel (HVOF) spraying; alternatively, it may be obtained by diffusion, for example solid state diffusion, liquid state diffusion or chemical vapor diffusion; MCrAlY is more typically obtained by spraying and Ni3Al is more typically obtained by diffusion.

The thickness tk (see FIG. 4) of the bond layer (404 in FIG. 4) is substantially uniform; the thickness tk may be in the range 0.01-1.0 mm, more particularly in the range 0.05-0.3 mm.

The top layer (402 in FIG. 4) is made of a ceramic material and may be made for example of DVC YSZ (dense vertically-cracked yttria-stabilized zirconia) or DVC DySZ (dense vertically-cracked dysprosia-stabilized zirconia) and may be obtained by spraying, for example Physical Vapor Deposition (PVD), Low Pressure Plasma Spraying (LPPS), Vacuum Plasma Spraying (VPS) Air Plasma Spraying (APS), or High Velocity OxyFuel (HVOF) spraying).

The thickness of the top layer may be uniform or variable. According to a typical embodiment, there is a first thickness h1 (see FIG. 4) at the "lowlands" of the base surface and a second thickness h2 (see FIG. 4) at the "peaks" of the "ridges" of the base surface, the first thickness h1 being greater than the second thickness h2; the thicknesses h1 and h2 may be in the range 0.6-6.0 mm. In an embodiment, the thickness h2 is in the range 0.6-3.0 mm.

The structures of FIG. 2 and FIG. 4 (which corresponds to a large set of similar structures) may be obtained through the method set out above and may be realized on a stator shroud.

According to a typical embodiment, the "ridges" are parallel to each other and arranged at a uniform distance or pitch P (see FIG. 4); the pitch P may be in the range 2.5-15.0 mm; it is to be noted that the pitch of the protrusions of the top surface (410 in FIG. 4) is equal to the pitch of the protrusions of the base surface (414 in FIG. 4).

The "ridges" according to an embodiment of the present invention may have different shapes and sizes (both transversally and longitudinally); with reference to FIG. 4, it is to be noted that the shapes and sizes primarily important for the sealing function of the abradable seal is the shapes and sizes of the protrusions 410; however, the shapes and sizes of the protrusions 410 derive from the shapes and sizes of the protrusions 414 through two covering steps; therefore, all these shapes and sizes are linked together.

Figure 5:
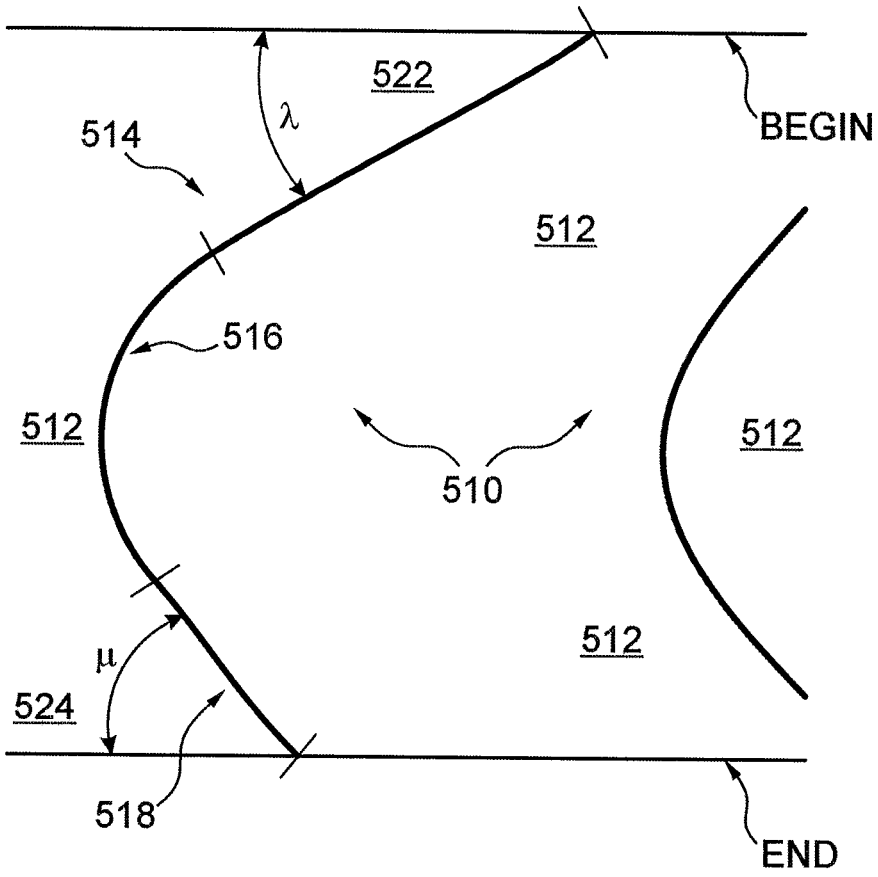
FIG. 5 shows schematically a partial longitudinal view (including "ridges" and "lowlands") of a patterned abradable part, this view being used for explaining several exemplary embodiments of the present invention.

The "ridges" 510 in the exemplary embodiment of FIG. 5, that are separated by "lowlands" 512, comprise a first initial straight section 514 (beginning at the BEGIN side of the seal); a second intermediate curved section 516 contiguous with the section 514; and a third final straight section 518 contiguous with the section 516 (ending at the END side of the seal).

In this exemplary embodiment sections 514 and 518 have different lengths, in particular section 514 is longer than section 518.

The angle λ (522 in FIG. 5) between the section 514 and a circumferential line (specifically lying in a plane transversal to the rotation axis of the turbomachine and corresponding to the BEGIN of the seal) may be in the range 25°-85°. The angle μ (524 in FIG. 5) between the section 518 and a circumferential line (specifically lying in a plane transversal to the rotation axis of the turbomachine and corresponding to the END of the seal) may be in the range 25°-85°. The angles λ and μ may be equal or different; in the exemplary embodiment of FIG. 5, they are different.

Figure 6A:
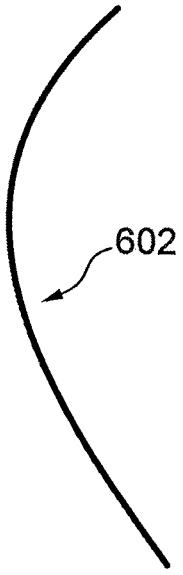
FIG. 6 shows schematically three possible longitudinal shapes of ridges of three patterned abradable parts according to exemplary embodiments of the present invention.
Figure 6B:
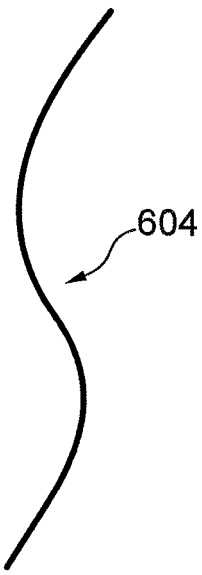
Figure 6C:
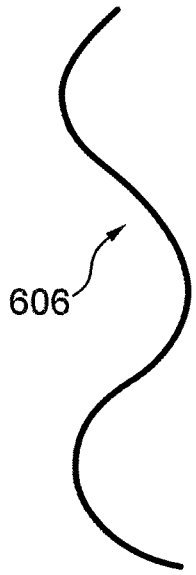

Differently from FIG. 5, the "ridges" 602, 604 and 606 in the exemplary embodiments of FIG. 6 comprise respectively one, two and three curved sections without straight sections.

FIG. 4 may be used for understanding many possible transversal shapes of the protrusions, in particular the "ridges". As already said, the shapes and sizes of the protrusions (414 in FIG. 4) of the base surface are similar, even if not identical, to the shapes and sizes of the protrusions (410 in FIG. 4) of the top surface.

The cross-section shape of the protrusions (414 in FIG. 4) of the base surface may be a triangle, for example with rounded corners (more particularly with rounded "peak" of e.g. 0.5 mm radius), or a trapezium (i.e. a quadrilateral with one pair of parallel sides). The cross-section shape of the protrusions (410 in FIG. 4) of the top surface may be a triangle, for example with rounded corners (more particularly with rounded "peak" of e.g. 0.5 mm radius), or a trapezium (i.e. a quadrilateral with one pair of parallel sides). One possibility is that the element 414 is a triangle and that element 410 is a trapezium. It is to be noted that the initial shape of the element 410 may be a triangle and that, after rubbing, the final shape of the element 410 is a trapezium.

The angle α (see FIG. 4) on one side of the trapezium of the base surface may be in the range 25°-90°, particularly in the range of 30-75°, and more particularly about 45°. The angle β (see FIG. 4) on the other side of the trapezium of the base surface may be in the range 25°-90°, particularly in the range of 30-75°, more particularly about 45°. The angles α and β may be equal or different; in the exemplary embodiment of FIG. 4, they are equal; possible exemplary combinations are: 45° and 45°, 30° and 30°, 60° and 60°, 30° and 60°, 60° and 30°.

The angle γ (see FIG. 4) on one side of the trapezium of the top surface may be in the range 25°-90°, particularly in the range of 30-75°, and more particularly about 45°. The angle δ (see FIG. 4) on the other side of the trapezium of the top surface may be in the range 25°-90°, particularly in the range of 30-75°, and more particularly about 45°. The angles γ and δ may be equal or different; in the exemplary embodiment of FIG. 4, they are equal; possible exemplary combinations are: 45° and 45°, 30° and 30°, 60° and 60°, 30° and 60°, 60° and 30°.

It is to be expected that angle γ is typically less (only a bit less, e.g. 5° to 10°) than angle α and that angle δ is typically less (only a bit less) than angle β.

As far as the trapezium of the base surface is concerned, its height H1 (see FIG. 4) may be in the range 0.5-5.0 mm, and its upper base L1 (see FIG. 4) may be in the range 0.0-5.0 mm; if the upper base is in the range of 0.0-0.5 mm, the trapezium may be considered a triangle. As far as the trapezium of the top surface is concerned, its height H2 (see FIG. 4) may be in the range 0.5-5.0 mm, and its upper base L2 (see FIG. 4) may be in the range 0.0-5.0 mm; if the upper base is in the range of 0.0-0.5 mm, the trapezium may be considered a triangle.

It is to be expected that height H2 is typically less (only a bit less) than height H1 and that upper base L2 is typically more (only a bit more) than angle L1.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

The invention claimed is:

1. A method of manufacturing a component of a turbomachine, the component comprising a body having a base surface including patterned protrusions of the base surface separated from one another by flat portions of the base surface, the patterned protrusions shaped as ridges having a trapezium shaped cross-section, the method comprising:

covering the base surface with a bond layer including patterned protrusions separated from one another by flat portions corresponding to the flat portions of the base surface; and applying a top layer made of abradable ceramic material to cover the bond layer creating a top surface of the component that is not machined and includes patterned protrusions shaped so as to be similar to the shapes of the patterned protrusions of the base surface and the bond layer;

wherein a thickness of the applied top layer covering the flat portion of the bond layer is greater than a thickness covering the patterned protrusions of the bond layer.

2. The method of claim 1, wherein the patterned protrusions of the base surface of the body are obtained by casting, milling, grinding, electric discharge machining or additive manufacturing.

3. The method of claim 1, wherein the bond layer is made of Ni3Al and is obtained by diffusion.

4. The method of claim 1, wherein the top layer is made of DVC YSZ or DVC DySZ and is applied by spraying.

5. The method of claim 1, wherein the body is made of a nickel base superalloy.

6. A component of a turbomachine, the component comprising:

a body of the component;

a bond layer covering a base surface of the body, wherein the base surface includes patterned protrusions separated from one another by flat portions, the base surface patterned protrusions shaped as ridges having a trapezium shaped cross-section, and wherein the bond layer includes patterned protrusions separated from one another by flat portions corresponding to the flat portions of the base surface; and a top layer covering the bond layer to form a top surface of the component that is not machined, the top layer being made of abradable ceramic material and including patterned protrusions separated from one another by a flat portion and shaped so as to be similar to the shapes of the patterned protrusions of the base surface and bond layer;

wherein a thickness of the top layer covering the flat portion of the bond layer is greater than a thickness covering the patterned protrusions of the bond layer.

7. The component of claim 6, wherein the protrusions of the base surface and of the top surface are a set of shaped ridges parallel to each other.

8. The component of claim 7, wherein each of the shaped ridges comprises:

a first straight section;

a second curved section contiguous with the first straight section; and a third straight section contiguous with the second curved section.

9. The component of claim 7, wherein each of the shaped ridges comprises two or more curved sections.

10. The component of claim 6, wherein the body is made of a nickel base superalloy.

11. A turbomachine comprising at least one component, the component comprising:

a body of the component;

a bond layer covering a base surface of the body, wherein the base surface includes patterned protrusions separated from one another by flat portions, the base surface patterned protrusions shaped as ridges having a trapezium shaped cross-section, and wherein the bond layer includes patterned protrusions separated from one another by flat portions corresponding to the flat portions of the base surface; and a top layer covering the bond layer to form a top surface of the component that is not machined, the top layer being made of abradable ceramic material and including patterned protrusions separated from one another by a flat portion and shaped so as to be similar to the shapes of the patterned protrusions of the base surface and bond layer;

wherein a thickness of the top layer covering the flat portion of the bond layer is greater than a thickness covering the patterned protrusions of the bond layer.

12. The turbomachine of claim 11, wherein the protrusions of the base surface and of the top surface are a set of shaped ridges parallel to each other.

13. The turbomachine of claim 11, wherein each of the shaped ridges comprises:

a first straight section;

a second curved section contiguous with the first straight section; and a third straight section contiguous with the second curved section.

14. The turbomachine of claim 12, wherein each of the shaped ridges comprises two or more curved sections.

15. The turbomachine of claim 11, wherein the body is made of a nickel base superalloy.

16. The method of claim 3, wherein the bond layer is obtained by solid state diffusion, liquid state diffusion, or chemical vapor diffusion.

17. The method of claim 1, wherein the body is made of stainless steel.

18. The method of claim 1, wherein the ridges of the base surface include three curved sections.

* * * * *